US012520894B2

(12) United States Patent
Bickford et al.

(10) Patent No.: US 12,520,894 B2
(45) Date of Patent: Jan. 13, 2026

(54) GESTURE AND ARTICULATION OF A COSMETIC APPLICATOR WITH A SPRING OR COMPRESSED CLAMPING MECHANISM

(71) Applicant: L'Oreal, Paris (FR)

(72) Inventors: William Robert Bickford, Scotch Plains, NJ (US); Yingchao Chen, Scotch Plains, NJ (US); Francesca D. Cruz, Sleepy Hollow, NY (US); Sylvie Poret-Fristot, Clark, NJ (US); Aline Aude Guimont, South Orange, NJ (US); Karin Kaskiel, New York, NY (US); Chunhua Li, Hillsborough, NJ (US)

(73) Assignee: L'Oreal, Paris (FR)

( * ) Notice: Subject to any disclaimer, the term of this patent is extended or adjusted under 35 U.S.C. 154(b) by 607 days.

(21) Appl. No.: 17/823,412

(22) Filed: Aug. 30, 2022

(65) Prior Publication Data

US 2024/0065359 A1 Feb. 29, 2024

(51) Int. Cl.
*A45D 44/00* (2006.01)
*A41G 5/00* (2006.01)

(52) U.S. Cl.
CPC ..... *A41G 5/0086* (2013.01); *A45D 44/00* (2013.01)

(58) Field of Classification Search
CPC ..... A46B 5/0012; A46B 2200/1053; A45D 2/48; A45D 44/00; A45D 40/24; A45D 40/262; A45D 40/265; A45D 26/0066; A45D 2200/10; A41G 5/0086; A41G 5/02; A41G 5/00; B25B 9/00; B25B 9/02; B25B 9/04
USPC ..... 132/217, 216
See application file for complete search history.

(56) References Cited

U.S. PATENT DOCUMENTS

| | | | | |
|---|---|---|---|---|
| 2,268,082 | A | 12/1941 | Phillips, Sr. | |
| 2,552,095 | A * | 5/1951 | Hickey | A45D 2/48 132/217 |
| 3,478,754 | A | 11/1969 | Martin, Jr. | |
| 3,670,742 | A | 6/1972 | Weaner | |
| 8,408,218 | B2 * | 4/2013 | Anderson | A45D 40/18 132/218 |
| 2007/0267036 | A1 * | 11/2007 | Cho | A45D 2/48 132/217 |

(Continued)

FOREIGN PATENT DOCUMENTS

| | | |
|---|---|---|
| FR | 780048 | 4/1935 |
| FR | 3090282 A1 | 6/2020 |

(Continued)

*Primary Examiner* — Eric J Rosen
*Assistant Examiner* — Luis Ruiz Martin
(74) *Attorney, Agent, or Firm* — Christensen O'Connor Johnson Kindness PLLC

(57) ABSTRACT

Applicators for grasping and applying small items, such as fibers and eyelashes, are disclosed. The applicators passively hold the items and a user actuates the applicator to release the items. An applicator includes a compression spring that forces a disc against a disc retention element to hold the items passively, and a button is pressed to separate the disc from the disc retention element to release the items. An applicator includes an expansion spring that holds items between coils of the spring passively, and a button is pressed to separate the spring coils to release the items.

9 Claims, 11 Drawing Sheets

(56) References Cited

U.S. PATENT DOCUMENTS

| | | | |
|---|---|---|---|
| 2018/0206570 | A1 | 7/2018 | Blanc et al. |
| 2020/0128897 | A1 | 4/2020 | Okuda et al. |
| 2022/0000203 | A1 | 1/2022 | Samain et al. |

FOREIGN PATENT DOCUMENTS

| | | | |
|---|---|---|---|
| GB | 2516622 | A | 2/2015 |
| JP | 5717277 | B2 | 5/2015 |
| KR | 200242063 | Y1 | 10/2001 |

* cited by examiner

GESTURE AND ARTICULATION OF A COSMETIC APPLICATOR WITH A SPRING OR COMPRESSED CLAMPING MECHANISM

SUMMARY

Systems, devices, and methods that leverage effective gesture and applicator articulation and employ compressive clamping forces supplied by a spring, a spring-backed clamping disc, a mechanical energy store assembly, etc., to apply false eyelashes individual eyelashes, lash clusters, lash bunches, clumps of fibers, or the like.

Ergonomic applicator systems, devices, and methods that are reconfigurable and enable fine, precise, repeatable motor movements for holding, releasing, handling, positioning of delicate items such as false eyelashes, or the like. In a first configuration, the applicators hold the objects passively, without applying manual pressure, and release the objects when applying manual pressure in the second configuration.

In an embodiment, the applicators provide an ergonomic form of applicator with ergonomic features conducive to ease of application of cosmetic fibers and lashes configurations to the eye and around the eye and eyebrow areas, for example.

In an embodiment, the application of fibers and lashes employs an adhesive, a magnetic element, a magnetic cosmetic formulation, an adhesive mascara (adhesive with color), or the like.

In an embodiment, the applicators provide a locking and holding first configuration as well as an open or unlocked second configuration to first engage lashes, held in interstitial spaces between clamping discs, spring coils, or retention elements, and release the false lashes when in position to apply to natural lashes.

The applicators comprise a specialized tip at the end of the spring applicator configured to finish or fixing gestures to manage and place a partial or full false lashes, or individual fibers.

The applicators comprise mechanical or electro-mechanical components to twist or rotate the spring either mechanically (by a hand operated assembly or motor) or electrically (powered motor) when applying.

In an embodiment, the applicators include a disc (round) having an asymmetric geometry (example a curved side that from the top would resemble a crescent moon) for additional functionality. In an embodiment, the symmetric form is rotatable in either direction about a rotation axis.

In an embodiment, the applicators are configured to enable a user to extend or retract the applicator tip for range of gesture options.

In an embodiment, the applicators are configured to enable a user to orbitally or angularly position the applicator tip for a range of applications.

In an embodiment, the applicators include contact surfaces (spring or discs) with a coating to repel formulation, adhesives, etc., and also to slightly hold or otherwise change the surface properties inherent in the alloy of the spring, such as self-cleaning properties from hydrophobicity ("Lotus Effect"), slippery liquid-infused porous surfaces ("SLIPS"), oxidized surfaces, surfactants, films, hydrophobic/oleophobic, hydrophilic/oleophilic.

In an embodiment, the applicators include a gripping function on one end (spring or discs) and a clamping function on the other end. Gripping false lashes aids in helping the user place the lashes, then a clamping side/function would press these lashes into a glue or an adhesive mascara, finalizing the look and placement.

In an embodiment, the applicators are configured to easily grab/retrieve fibers, manipulate them into the best application position, and applying them to the lashes (with or without adhesive).

In an embodiment, during operation, the lash is "locked" to the discs or spring when the button is released in the first configuration, enabling easy and fluid positioning, and the lashes are released when the button is depressed in the second configuration.

In an embodiment, applicators include surface materials or coatings that are cleanable, washable, sanitizeable, etc. The disc surfaces, for example, are composed of plastics that resist the stickiness of formulations, and are also composed of antimicrobial or antibacterial materials for example.

In an embodiment, the components of the applicators are made of plastic (e.g., PET (polyethylene terephthalate), PP (polypropylene), PE (polyethylene), or the like)), other suitable polymers, sustainable materials, additive manufactured materials, metals common to cosmetic packaging, or the like. In an embodiment, springs are typically metal, stainless steel spring stock, plastic, high density polymers, be a fulcrum or part under tension or made from sustainable/renewable materials.

In an embodiment, the applicators are designed to be durable and reusable over many applications. The applicators improve the gesture and ability of the user to place very fine, complex fibers and forms (lashes) onto/over natural lashes and around the eye area. In an embodiment, the applicators allow the user to hold lashes passively (lashes are gripped by a mechanism) to place on the eye. In an embodiment, the applicators operate to hold fibers and lashes without pressure exerted by the user. In an embodiment, the applicators are operable to handle full and partial lashes and have several functions on the platform.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

In an aspect, this disclosure is related to applicators that leverage effective gesture and applicator articulation and employ compressive clamping forces supplied by a spring, a spring-backed clamping disc, a mechanical energy store assembly, etc., to apply false eyelashes individual eyelashes, lash clusters, lash bunches, clumps of fibers, or the like.

In an embodiment, the applicators include components such as a spring or spring-backed grips configured to apply a compressive clamping force to retain or release full or partial false eyelashes, individual lashes, lash bunches, clumps of fibers, etc. and to apply them onto natural eyelashes or eyelids.

Figure 1A:
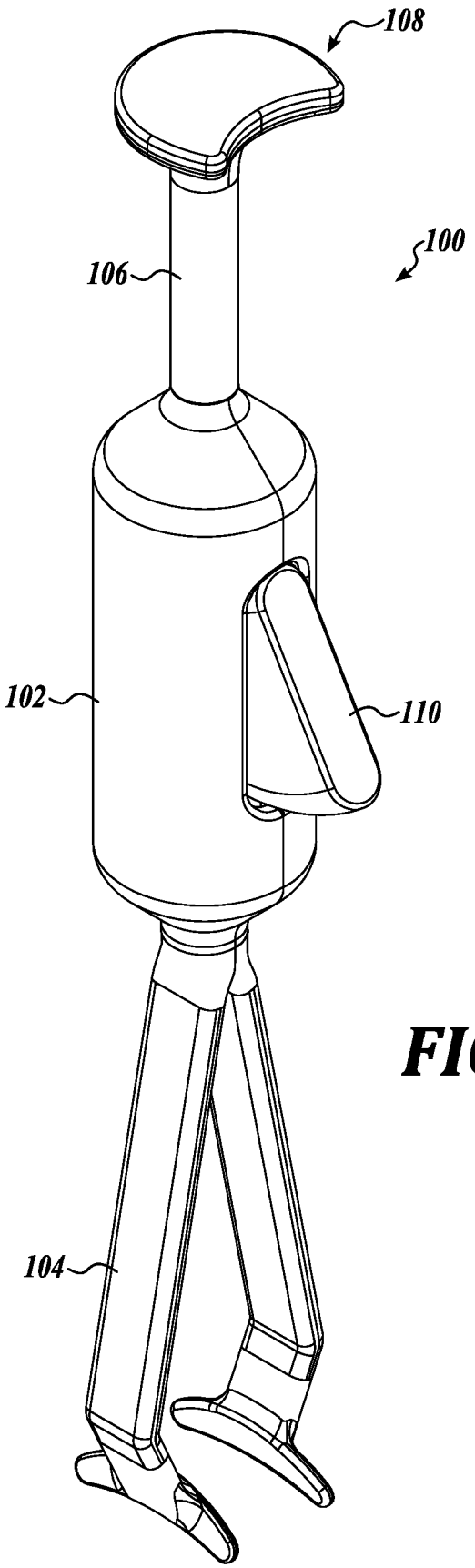
FIG. 1A is a diagrammatical illustration of one embodiment of an applicator.
Figure 1B:
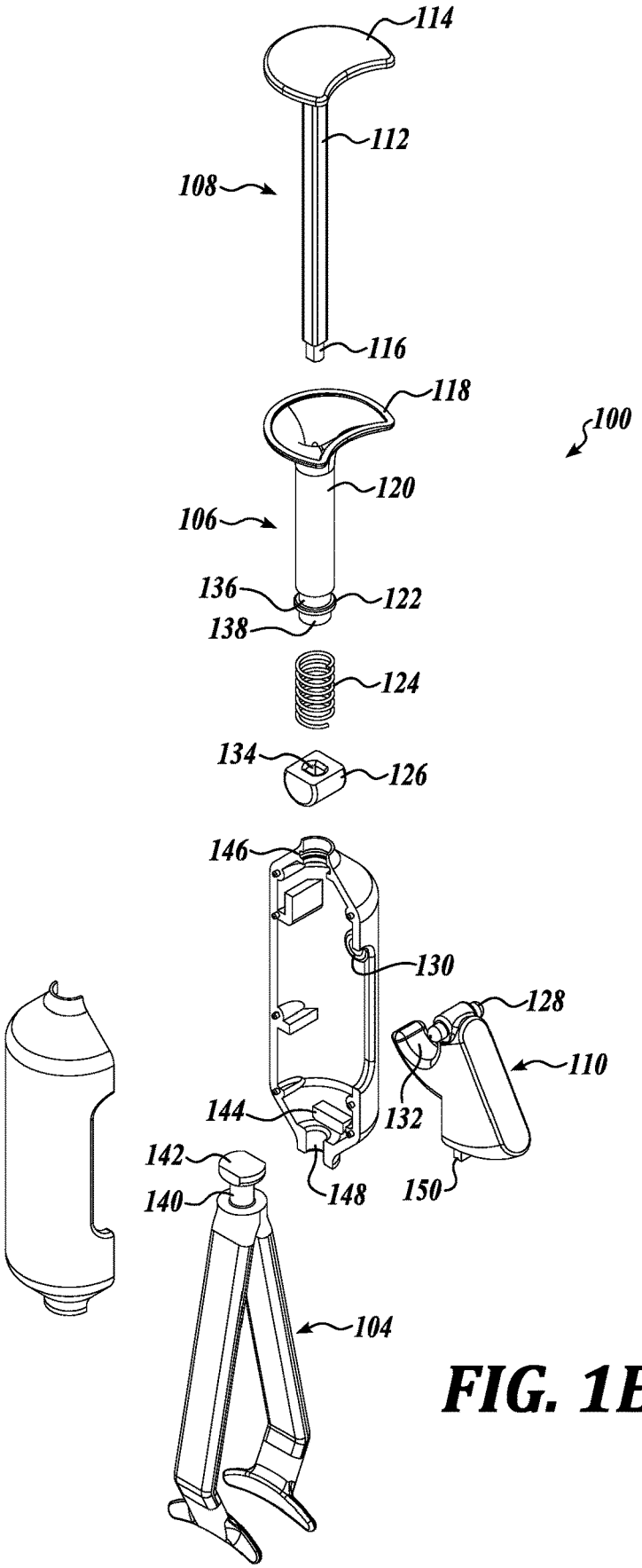
FIG. 1B is a diagrammatical illustration of an exploded view of the applicator of FIG. 1A.
Figure 1C:
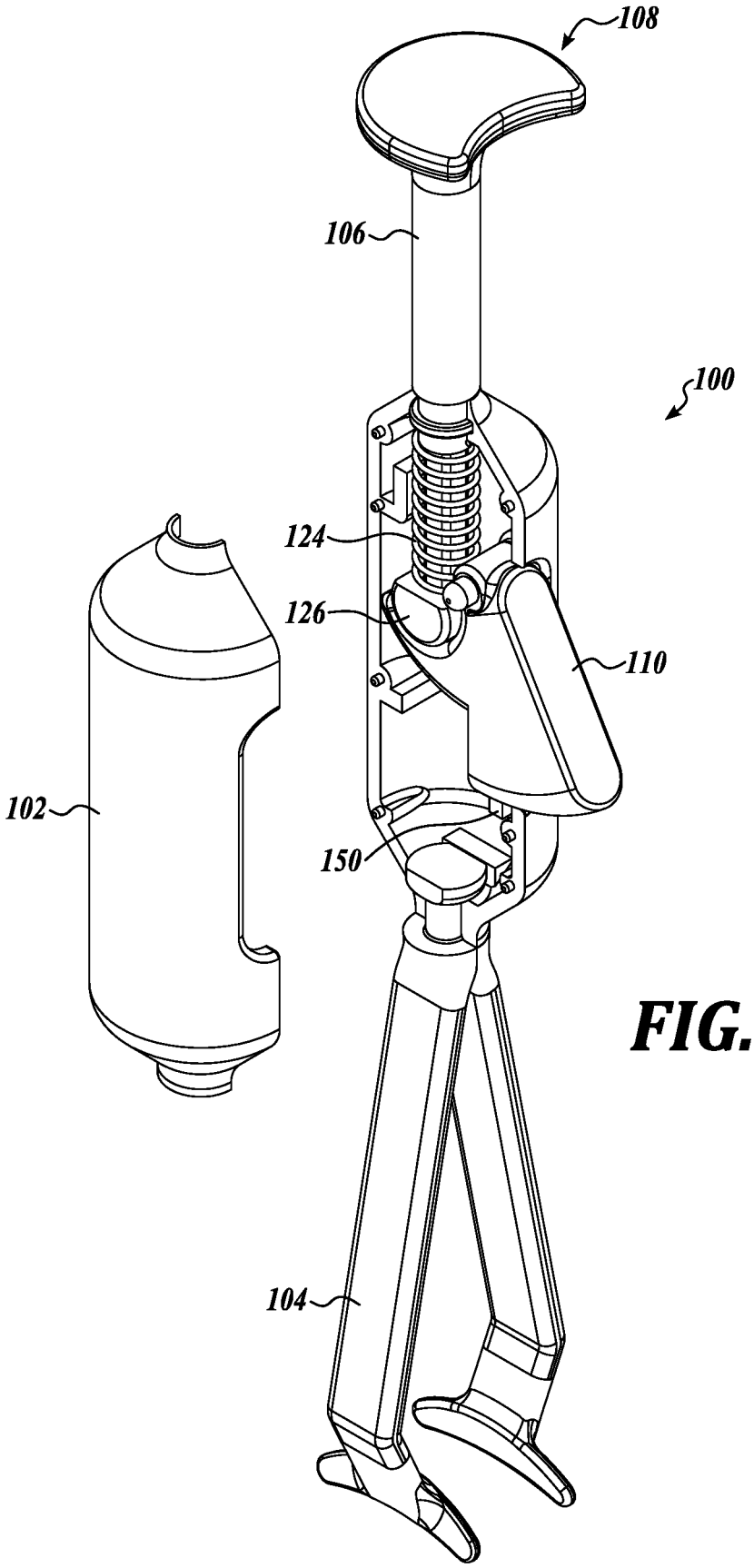
FIG. 1C is a diagrammatical illustration of the interior of the applicator of FIG. 1A.

FIGS. 1A, 1B, and 1C illustrate one embodiment of an applicator 100. The applicator 100 includes a housing 102, which is made of two halves joined together. The housing 102 is generally a cylindrical shape with rounded shapes on both ends of the cylinder. One end of the housing 102 is connected to a shaft housing 106. The second end of the housing 104 is connected to pair of tweezers 104. The distal end of the shaft housing 106 includes a lash retainer 108, described in greater detail below.

Referring to FIG. 1B, the components of the applicator 100 are shown individually to better describe each component.

In an embodiment, the tweezers 104 include plastic or metal arms connected together to create a spring action that requires pressure to close the arms and the arms are normally open in the absence of pressure. In an embodiment, the connection of the tweezers 104 to the housing 102 is via a button 142 connected to a short stem piece 140, which in turn is connected to the proximal ends of both arms of the tweezers 104. The short stem piece 104 fits into a corresponding hole 148 at the end of the housing 102. The sides of the button 142 include two straight edges opposite to each other. Each of the straight edges abut next to a straight block 144 on each half of the housing 102, thus, preventing rotation of the tweezers 102. When the two halves of the housing 102 are joined the tweezers 102 are locked into the end of the housing 102 in a manner that prevents rotation.

In an embodiment, the housing 102 is generally hollow to allow the placement of a release button 110 (which is referred to as the actuator 110), a cam 126, and a spring 124. The release button 110 includes a portion including a touch surface that projects outside of the housing 102, as illustrated in FIG. 1A, which allows the user to actuate the lash retainer 108 open. The housing 102 is cutout to allow the release button to protrude from the housing 102. The release button 110 includes a pivot 128 on one end of the release button 110 for allowing a rotating motion. The pivot 128 includes two pins that fit into a respective hole on each of the two halves of the housing 102. The release button 110 includes a bump 150 that functions to stop the button 110 from rotating outward out of the housing 102. The bump 150 hits against the inside of the housing 102 to prevent the release button 110 from swinging excessively outside of the housing 102.

In an embodiment, the release button 110 includes a rotary to linear motion converter that converts a rotary motion of the release button 110 into a liner motion of a shaft 112 to open and close the lash retainer 108. In one embodiment, the rotary to linear motion converter includes the release button having a hook 132 that is eccentrically placed distally from the pivot 128 of rotation. The hook 132 includes a concave flat surface that interfaces with a corresponding rounded surface of a cam 126. The cam 126 is generally barrel shaped and placed sideways within the hook 132, so that the axis of rotation of the cam 126 is parallel to the axis of rotation of the pivot 128. The cam 126 has a flat surface on top facing the shaft 112. The cam 126 is allowed to rotate in the hook 132 when the release button 110 is depressed, thereby converting the rotation of the release button 110 into linear motion of the shaft 112.

In an embodiment, the cam 126 includes an opening 134 that accommodates the proximal end of the shaft 112. The shaft 112 has a pin 116 on the proximal end that fits into the opening 134 in the cam 126.

In an embodiment, the shaft 112 is an elongated rod, the proximal end of which fits into the cam 126, and the opposite distal end having one disc 114 of a pair that comprise the lash retainer 108. The disc 114 is actuated by the release button 110 to move up in a second configuration from the closed first configuration.

Non-limiting examples of disc geometric shapes include full or partial discs, discoid geometric shapes, annular discs, oblates, oblate ellipsoids, oblate spheres, symmetrical and asymmetrical geometric shapes, regular and irregular geometric shapes, or the like.

In an embodiment, the shaft 112 resides within a shaft housing 106. The shaft housing 106 includes a hollow tube 120. The distal end of the hollow tube 120 is connected to the disc retention element 118 that together with the disc 114 make up the lash retainer 108. The disc retention element 118 is stationary, since the disc retention element 118 is not actuated by the release button 110. The upper disc 114 and the lower disc retention element 118 cooperate to allow the gripping of fibers, such as fake eyelashes between the bottom side of the upper disc 114 and the upper side of the lower disc retention element 118. Disc 114 and disc retention element 118 come in various shapes, including symmetrical, such as circular, asymmetrical (as shown), the gripping surfaces are also be provided in various shapes as further described below.

In an embodiment, the proximal end of the shaft housing 106 is configured to attach to one end of the housing 102. In one configuration, the proximal end of the shaft housing 106 includes a lip and groove construction to fix the shaft housing 106 on the housing 102. The lip and groove configuration includes forming or otherwise providing a lip 122 in the form of a ring on the proximal end of the shaft housing 106, wherein immediately above and below the lip 122, there are provided two circular grooves 136, 138 having a smaller diameter than the diameter of the lip 122. Conversely, the end of housing 102 is configured with one groove 146 and two ring lips that accommodate the end of the shaft housing 106.

In an embodiment, the housing 102 further includes a spring 124 that biases the upper disc 114 to press against the lower disc retention element 118 when the release button 110 is not being actuated, which is the first closed or gripping configuration of the lash retainer 108. The proximal side of the shaft 112 is enclosed with the center of the spring 124. The spring 114 is a coil compression spring 124 that becomes shorter as a load is placed to counteract the spring 124.

In an embodiment, the release button 110 acts as lever when depressed which causes the hook 132 to pivot upwardly. As the hook 132 moves upward the cam 126 also moves upward while simultaneously rotating, thereby converting the rotating motion of the release button to a linear motion of the shaft 112. The same rotational motion compresses the spring 124, thereby pushing the shaft 112 upward causing separation of the upper disc 114 with respect to the lower disc retention element 118 to the second open configuration to release the material that is being gripped therebetween.

The distal top end of the spring 124 fits within the groove 128 at the proximal end of the shaft housing 106 to fix the top end of spring 124 in a stationary position, and the bottom end of the spring 124 rests against the flat surface at the top of the cam 126 and is allowed to move with the cam. The distal end of the spring 124 is fixed or stationary, while the proximal end of the spring 124 travels as a result of the cam 126 and release button 110 movement.

Referring to FIG. 1C, the assembled applicator 100 is illustrated with one half of the housing 102 removed. Specifically, the top end of the spring 124 is fixed against the housing 102, and the bottom end of the spring 124 pushes down on the cam 126. In turn, the cam 126 pushes down against the hook 132, which due to eccentric position of the hook 132 in relation to the pivot of the release button 110, the hook 132 acts as a lever to rotate the release button 110 outward away from the housing 102, the release button 110 being stopped by the bump 150 hitting against the housing 102.

When the release button 110 is depressed, the release button 110 together with the hook 132 rotates around the pivot, and the cam 126 rotates within the hook 132 while being moved upward.

Figure 2A:
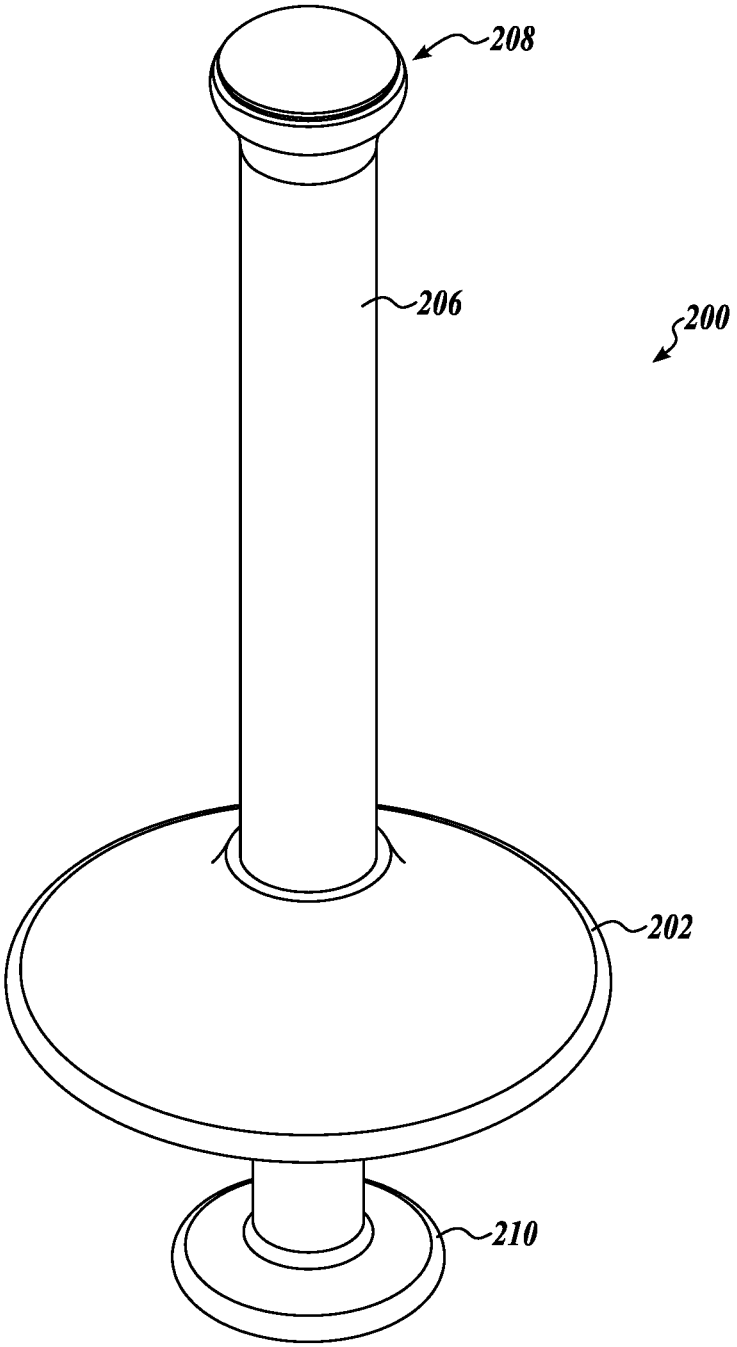
FIG. 2A is a diagrammatical illustration of one embodiment of an applicator.
Figure 2B:
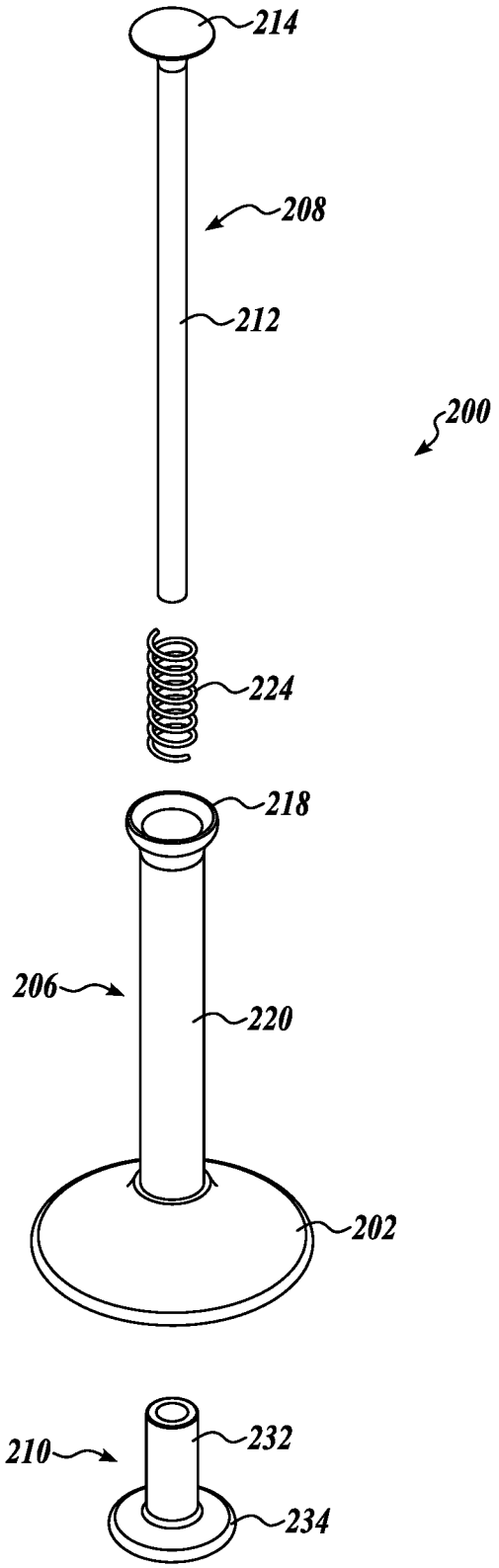
FIG. 2B is a diagrammatical illustration of an exploded view of the applicator of FIG. 2A.
Figure 2C:
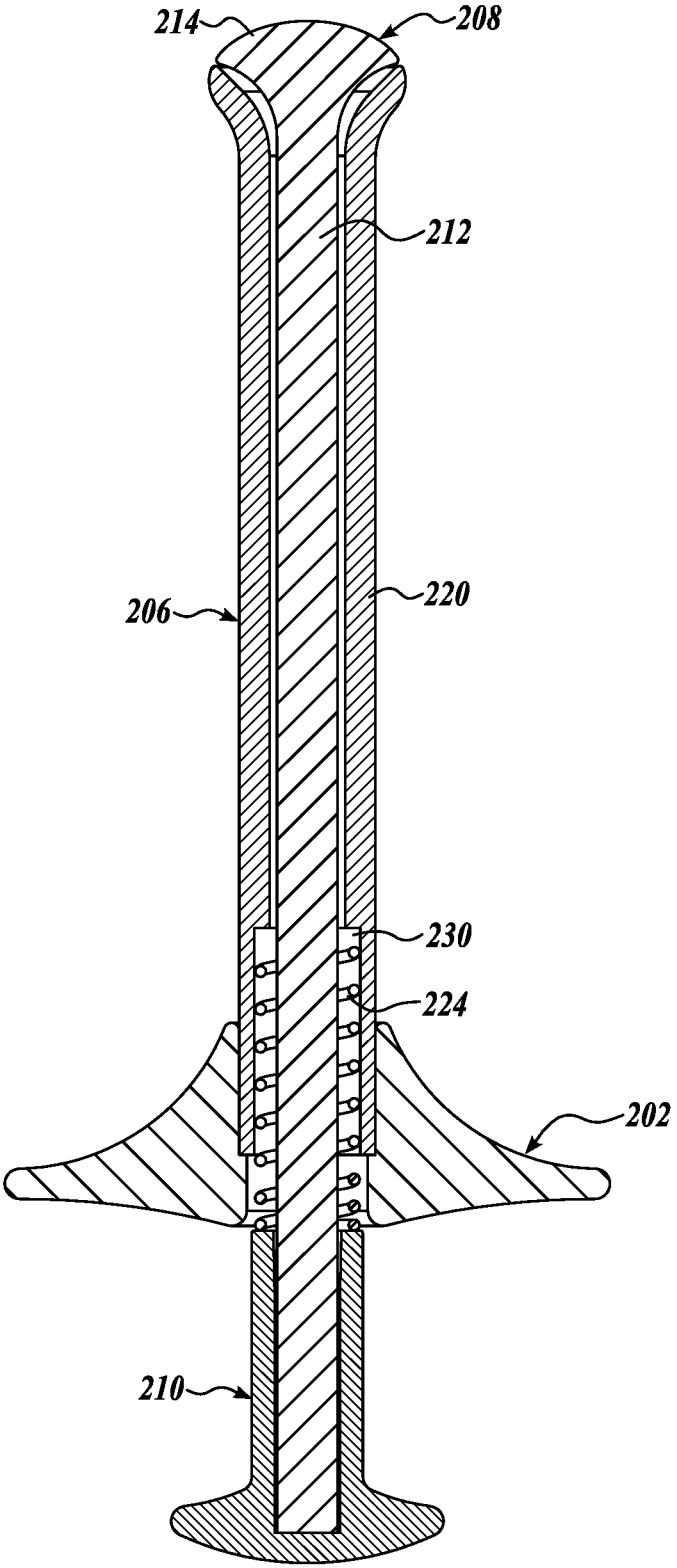
FIG. 2C is a diagrammatical illustration of a cross section of the applicator of FIG. 2A.

FIGS. 2A, 2B, and 2C illustrate one embodiment of an applicator 200. The applicator 200 includes a hollow shaft housing 206. The shaft housing 206 is generally a cylindrical shape. The distal end of the shaft housing 206 includes a lash retainer 208. The lash retainer 208 is configured similar to the lash retainer 108, including an upper disc that is actuated to separate from the lower disc retention element, thereby, releasing fibers captured therebetween.

The applicator 200 includes a plunger 210 (the actuator 210) that actuates the lash retainer 208 to open to the second configuration from the closed first configuration. The applicator 200 includes a handle 202 that allows holding the applicator to allow pressing on the plunger 210. The handle 202 includes a circular handle that surrounds the proximal end of the shaft housing 206.

Referring to FIG. 2B, the components of the applicator 200 are shown individually to better describe each component.

A linearly movable shaft 212 resides within the shaft housing 206. The shaft 212 includes an elongated rod, the proximal end of which is connected to the plunger 210, and the opposite distal end having one disc 214 of a pair that comprise the lash retainer 208. The disc 214 is actuated to move up in the second configuration from the closed first configuration.

The shaft housing 206 includes a hollow tube 220. The distal end of the hollow tube 220 is connected to the disc retention element 218 that together with the disc 214 make up the lash retainer 208. The disc retention element 218 is stationary, since the disc retention element 118 is not actuated by the plunger 210. The upper disc 214 and the lower disc retention element 218 cooperate to allow the gripping of fibers, such as fake eyelashes between the bottom side of the upper disc 214 and the upper side of the lower disc retention element 218. Disc 214 and disc retention element 218 come in various shapes, including symmetrical, such as circular (as shown), asymmetrical. The gripping surfaces are also provided in various shapes as further described below.

The proximal end of the shaft housing 206 is connected to the handle 202 to facilitate operation of the plunger 210. The handle 202 is provided in various shapes including circular. Generally, when operating the plunger 210, the thumb rests on the end of the plunger 210, while the index finger and the middle finger are placed against the distal side of the handle 202 and on opposite sides of the shaft housing 206.

The plunger 210 includes a hollow tube 232 that is fixed to the proximal end of the shaft 212, and an enlarged surface, such as a button 234, used for depressing the plunger 206.

The applicator 200 includes a spring 224 that is a coil compression spring 224 that biases the plunger 210 proximally, and therefore, the shaft 206 is biased similarly proximally, pressing the upper disc 214 against the lower disc retention element 218 when the plunger 104 is not depressed in the first configuration.

Referring to FIG. 2C, a cross section of the assembled applicator 200 is illustrated. Specifically, the spring 224 is placed coaxially with respect to the shaft 212 within a cavity 230 formed on the inside circumference of the shaft housing 206 toward the proximal end of the shaft housing 206. The distal end of the spring 224 is fixed stationary by abutting against a lip at the distal end of the cavity 230. The spring 224 is placed coaxially with the shaft 208, such that the shaft 208 passes through the center of the spring 224. The proximal end of the spring 224 presses against one end of the tube 232 of the plunger 210, which being attached to the proximal end of the shaft, the spring 224 biases the upper disc 214 to contact against the lower disc retention element 218 without the plunger being pressed. Upon depressing the plunger 210 against the spring 224, the upper disc 214 is actuated to separate from the lower disc retention element 218 to the second configuration, thereby releasing the fibers captured therebetween.

Figure 3C:
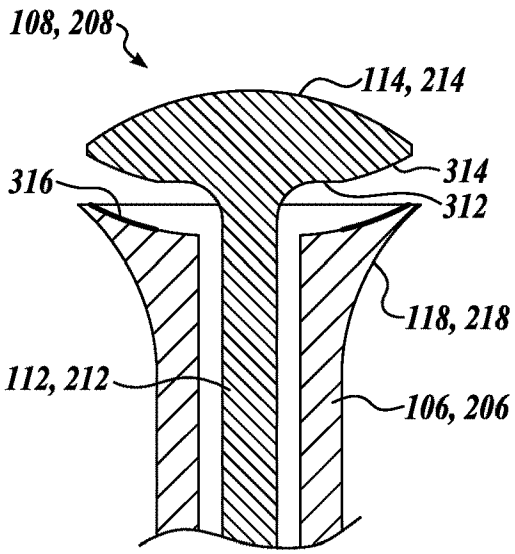
FIG. 3C is a diagrammatical illustration of one embodiment of a fiber grip comprising an upper and lower disc.
Figure 3B:
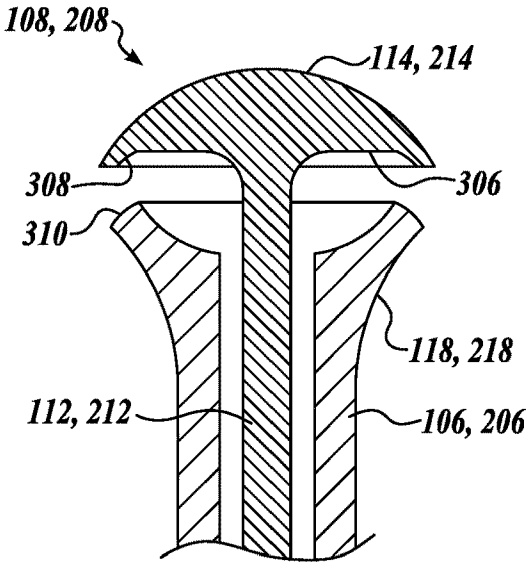
FIG. 3B is a diagrammatical illustration of one embodiment of a fiber grip comprising an upper and lower disc.
Figure 3A:
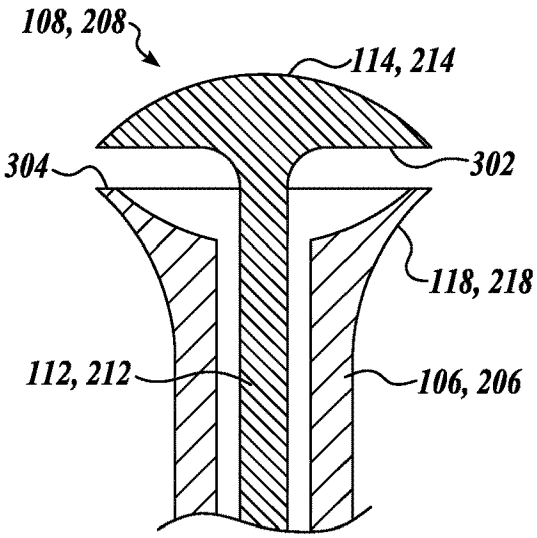
FIG. 3A is a diagrammatical illustration of one embodiment of a fiber grip comprising an upper and lower disc.

FIG. 3A is a diagrammatical illustration of one embodiment of a lash retainer that is used for the lash retainer 108 and 208 of the embodiments illustrated in FIGS. 1 and 2. The lash retainer 108, 208 includes an upper disc 114, 214 and a lower disc retention element 118, 218. The lower disc retention element 118, 218 is formed integrally with the shaft housing 106, 206, or alternatively, the lower disc retention element is connected to the top of the shaft housing. The lower disc retention element 118, 218 includes an opening that allows the shaft 112, 212 connected to the upper disc 114, 214 to pass therethrough. The upper disc 114, 214 is formed integrally to the shaft 112, 212, or alternatively, the upper disc is connected to the shaft.

FIG. 3A illustrates the bottom surface of the upper disc 114, 214 is a flat plane 302 that is orthogonal with respect to the shaft 112, 212. The lower disc retention element 118, 218 is "cupped" with a concave surface facing towards the bottom surface of the upper disc 114, 214. The cupped surface has a flat surface 304 around the periphery, wherein the flat periphery surface 304 of the lower disc retention element 118, 218 faces towards and contacts the bottom flat surface 302 of the upper disc 114, 214.

The upper disc 114, 214 and the lower disc retention element 118, 218 of FIG. 3A have a symmetrical shape with respect to the central axis, such as a circular shape or an asymmetrical shape, such as semicircular or crescent shape.

FIG. 3B is a diagrammatical illustration of one embodiment of a lash retainer that is used for the lash retainer 108 and 208 of the embodiments illustrated in FIGS. 1 and 2. The lash retainer 108, 208 includes an upper disc 114, 214 and a lower disc retention element 118, 218. The lower disc retention element 118, 218 is formed integrally with the shaft housing 106, 206, or alternatively, the lower disc retention element 118, 218 is connected to the top of the shaft housing. The lower disc retention element 118, 218 includes an opening that allows the shaft 112, 212 connected to the upper disc 114, 214 to pass therethrough. The upper disc 114, 214 is formed integrally to the shaft 112, 212, or alternatively, the upper disc is connected to the shaft.

FIG. 3B illustrates the bottom surface of the upper disc 114, 214 includes a depressed bottom surface. The bottom surface has a depressed flat surface 306 surrounding the area immediately adjacent to the shaft 112, 212. The bottom surface has an angled side surface 308 on the interior that extends from the outermost radial edge of the flat surface 306 to a lower outermost edge of the upper disc 114, 214. The angled side surface 308 is considered to slope upward from the outermost periphery of the upper disc or slopes downward in the outward radial direction. The angled side surface 308 is an interior-facing surface. The lower disc retention element 118, 218 is "cupped" with a concave surface facing towards the bottom surface of the upper disc 114, 214. The cupped surface has an angled flat surface 310 around the periphery of the lower disc retention element 118, 218, wherein the angle of flat periphery surface 310 of the lower disc retention element 118, 218 is the same angle as the angled side surface 308 of the upper disc 114, 214. The flat periphery surface 310 is an exterior-facing surface, so that the exterior-facing angled flat surface 310 of the lower disc retention element 118, 218 contacts the interior-facing angled side surface 308 of the upper disc 114, 214.

The upper disc 114, 214 and the lower disc retention element 118, 218 of FIG. 3B have a symmetrical shape with respect to the central axis, such as a circular shape or an asymmetrical shape, such as semicircular or crescent shape.

FIG. 3C is a diagrammatical illustration of one embodiment of a lash retainer that is used for the lash retainer 108 and 208 of the embodiments illustrated in FIGS. 1 and 2. The lash retainer 108, 208 includes an upper disc 114, 214 and a lower disc retention element 118, 218. The lower disc retention element 118, 218 is formed integrally with the shaft housing 106, 206, or alternatively, the lower disc retention element 118, 218 is connected to the top of the shaft housing 106, 206. The lower disc retention element 118, 218 includes an opening or hole in the center that allows the shaft 112, 212 connected to the upper disc 114, 214 to pass therethrough. The upper disc 114, 214 is formed integrally to the shaft 112, 212, or alternatively, the upper disc 114, 214 is connected to the shaft.

FIG. 3C illustrates the bottom surface of the upper disc 114, 214 includes a flat planer bottom surface 312 surrounding the area immediately adjacent to the shaft 112, 212. The bottom surface 312 has an angled side surface 314 facing the exterior that extends from the outermost radial edge of the flat surface 314 to a lower outermost edge of the upper disc 114, 214. The angled side surface 314 is considered to slope downward from the outermost periphery of the upper disc 114, 214 or to slope upward in the outward radial direction. The lower disc retention element 118, 218 is "cupped" with a concave surface facing towards the bottom surface of the upper disc 114, 214. The cupped surface has an angled flat surface 316 around the periphery of the lower disc retention element 118, 218, wherein the angle of flat periphery surface 316 of the lower disc retention element 118, 218 is the same angle as the angled side surface 314 of the upper disc 114, 214. The flat periphery surface 316 is an interior-facing surface, so that the interior-facing angled flat surface 316 of the lower disc retention element 118, 218 contacts the exterior-facing angled side surface 314 of the upper disc 114, 214.

The upper disc 114, 214 and the lower disc retention element 118, 218 of FIG. 3C have a symmetrical shape with respect to the central axis, such as a circular shape or an asymmetrical shape, such as semicircular or crescent shape.

Figure 4A:
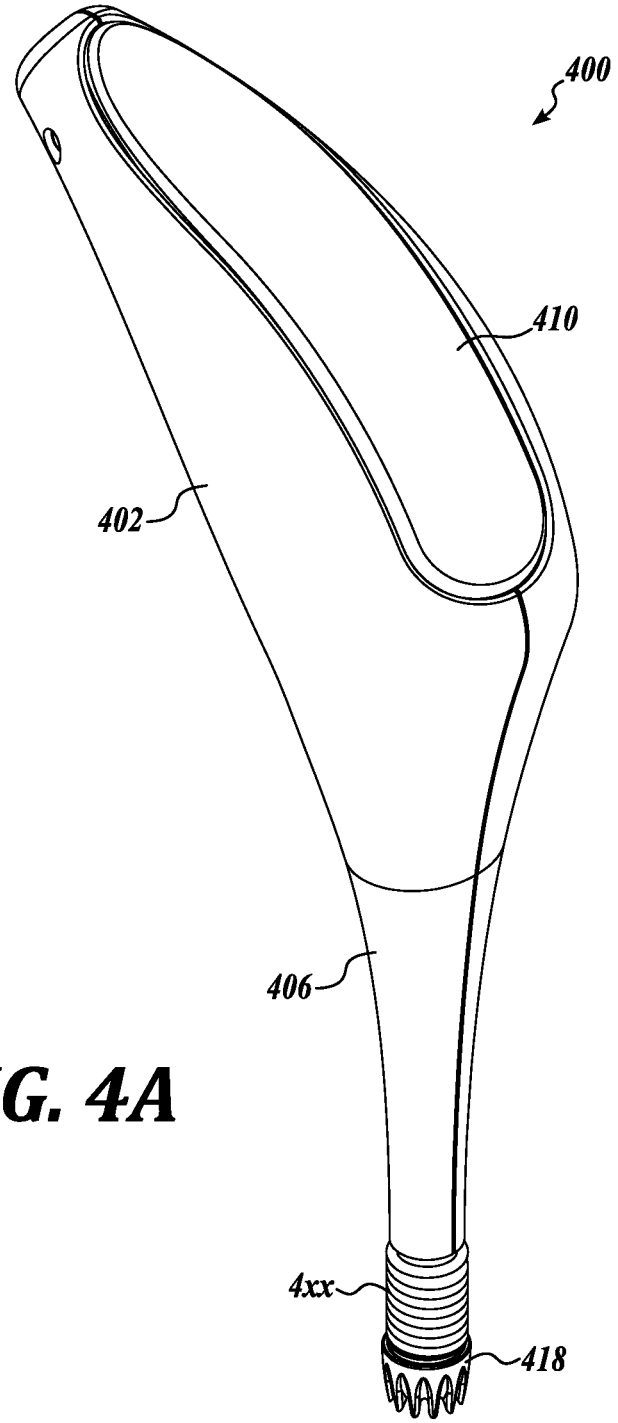
FIG. 4A is a diagrammatical illustration of one embodiment of an applicator.
Figure 4B:
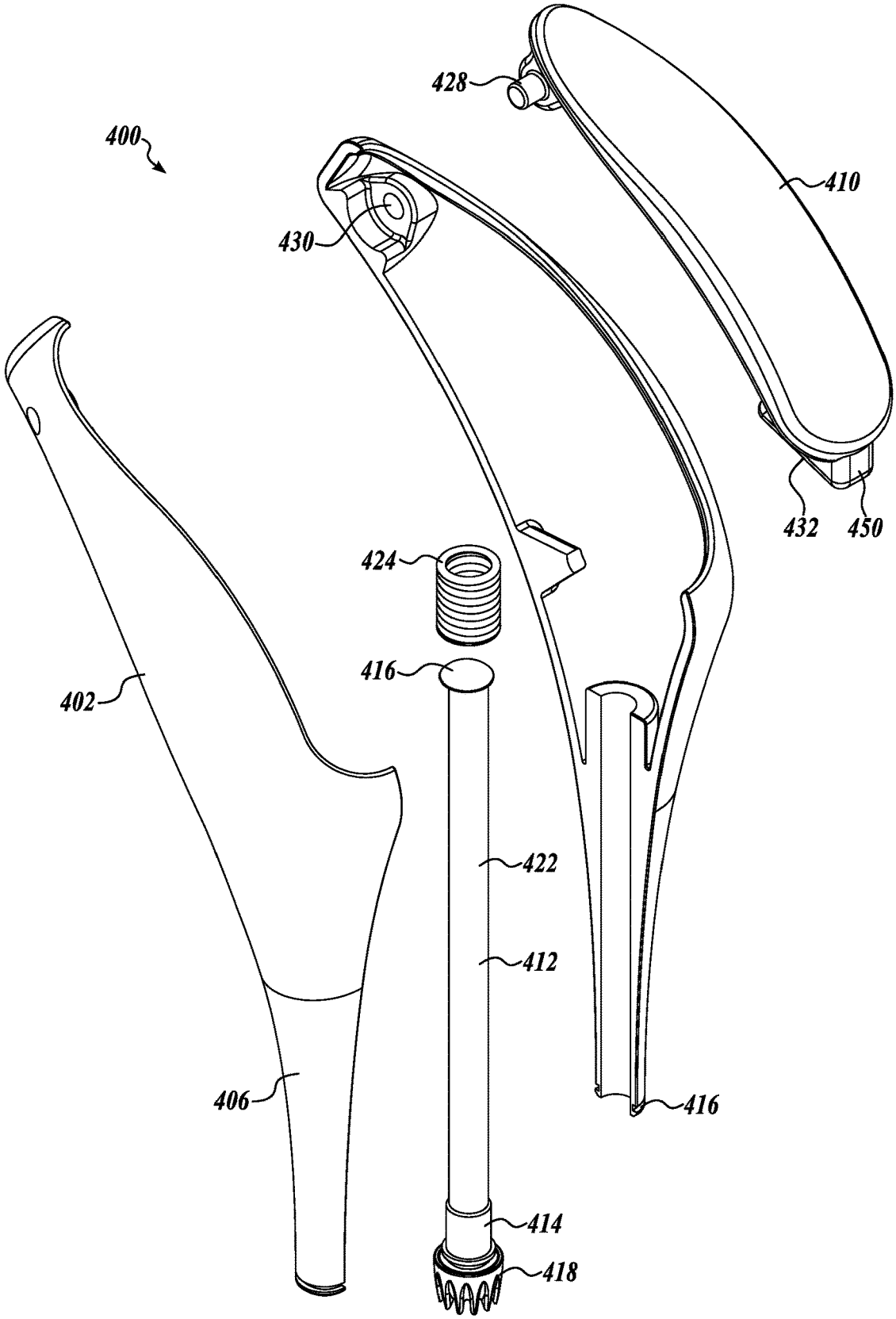
FIG. 4B is a diagrammatical illustration of an exploded view of the applicator of FIG. 4A.
Figure 4C:
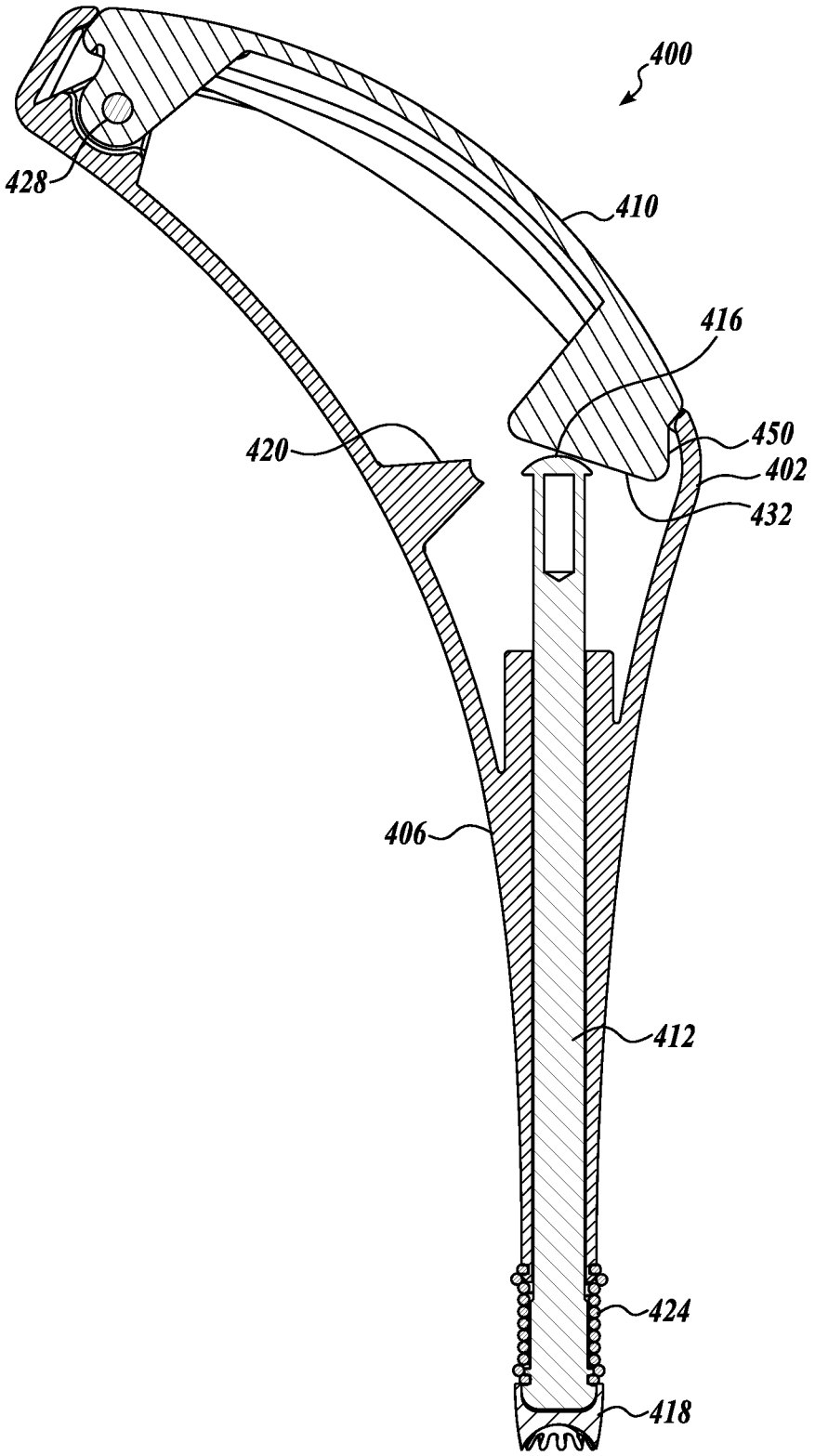
FIG. 4C is a diagrammatical illustration of a cross section of the applicator of FIG. 4A.

FIGS. 4A, 4B, and 4C illustrate one embodiment of an applicator 400. The applicator 400 includes a housing 402, which is made of two halves joined together. The housing 402 forms a curved or crescent-shaped handle for holding the applicator 400 and a shaft housing 406 is attached at an angle to the housing 402. In this embodiment, the applicator 400 includes a spring 424 at the distal end of the shaft housing, wherein the coils of the spring 424 are used to hold items between the coils. The housing 402 includes a button 410 (the actuator 410) that is configured to stretch the spring 424 coils to thereby release items from the spring 424. In this embodiment, a first configuration is where the spring coils are in contact with each other without any pressure on the button 410, and a second configuration is where the spring coils are separated by applying pressure on the button 410.

Referring to FIG. 4B, the components of the applicator 200 are shown individually to better describe each component.

A linearly movable shaft 412 resides within the shaft housing 406. The shaft 412 includes an elongated rod 422. A proximal end of the shaft 412 includes a rounded or hemispherical cap 416, and the distal end of the shaft 412 includes a spring seat 414, which fixes the distal end of the spring 424 to the distal end of the shaft 412. The spring 424 is a coil expansion spring, and the spring seat 414 is a groove around the periphery of the shaft 412 in which one coil of the spring 424 is seated.

The shaft housing 406 is illustrated as being a continuation of the housing 402 and is formed of two halves. However, the shaft housing 406 has an interior bore 404 diameter slightly greater than the exterior diameter of the shaft 412 allowing the shaft 412 to move linearly within the shaft housing 406.

The distal end of the shaft housing 406 includes a second spring seat 416 to which the proximal end of the spring 424 is fixed. The spring seat 416 is a groove around the periphery of the shaft housing 406 in which one coil of the spring 424 is seated. The spring 424 is an expansion coil spring that expands when under a load in tension. When the spring is under no tension, the coils of the spring are contacting each other, and this configuration is used to hold items between the coils.

In one embodiment, the applicator 400 includes a ring 418 at the distal end of the shaft 412. The ring 418 includes teeth, bristles, or tines that allow the user to touch up and manipulate the false lashes that have been applied.

Referring to FIG. 4C, a cross-sectional illustration of the applicator 400 shows the configuration of the shaft 412 and the button 410 that operates the spring 424. FIG. 4C shows the unbiased state of the spring 424 in the first configuration having the coils pressing against each other. In this unbiased state, the cap 416 at the proximal end of the shaft 416 is touching or very near to touching a cam surface 432 on one end of the button 410. The button 410 is prevented from moving outward from the housing 402 by a bump 450 formed at the end of the button 410. The bump 450 hits against the inside of the housing 402, thereby preventing the button 410 from rotating out of the housing 402.

The button 410 is configured as a lever that includes a distally placed pivot 428 at one end opposite to the cam surface 432. The cam surface 432 is designed to apply a force against the shaft 416 having a force component that linearly moves the shaft linearly and distally. When depressed, the button 410 rotates around the pivot 428, and the cam surface 432 contacts the rounded cap 416 at the proximal end of the shaft 412 at an angle. The angle of contact between the cam surface 432 and the rounded cap 416 occurs off center to the shaft 412 axis. Thereby, the cam imparts a horizontal force component and a vertical force component as the rounded end 416 slides along the cam surface. The shaft 412 being secured within the shaft housing 406, the shaft will resist the horizontal force component and move linearly due to the vertical force component. Therefore, the rotating motion of the lever 410 is converted to the linear motion of the shaft 412. The shaft 412 is driven distally. The spring 424 having the proximal end fixed to the distal end of the shaft housing 406, and the distal end of the spring 424 is fixed to the distal end of the shaft 412 will expand to the second configuration to separate the spring coils and release the items held between the coils. The button 410 rotation inward is limited by a second bump 420 placed inside of the housing 402. When the pressure is released on the button 410, the spring 424 returns to the non-extended state which pushes the shaft 412 proximally and rotates the button 410 outward until the bump 450 hits against the inside of the housing 402.

Figure 4D:
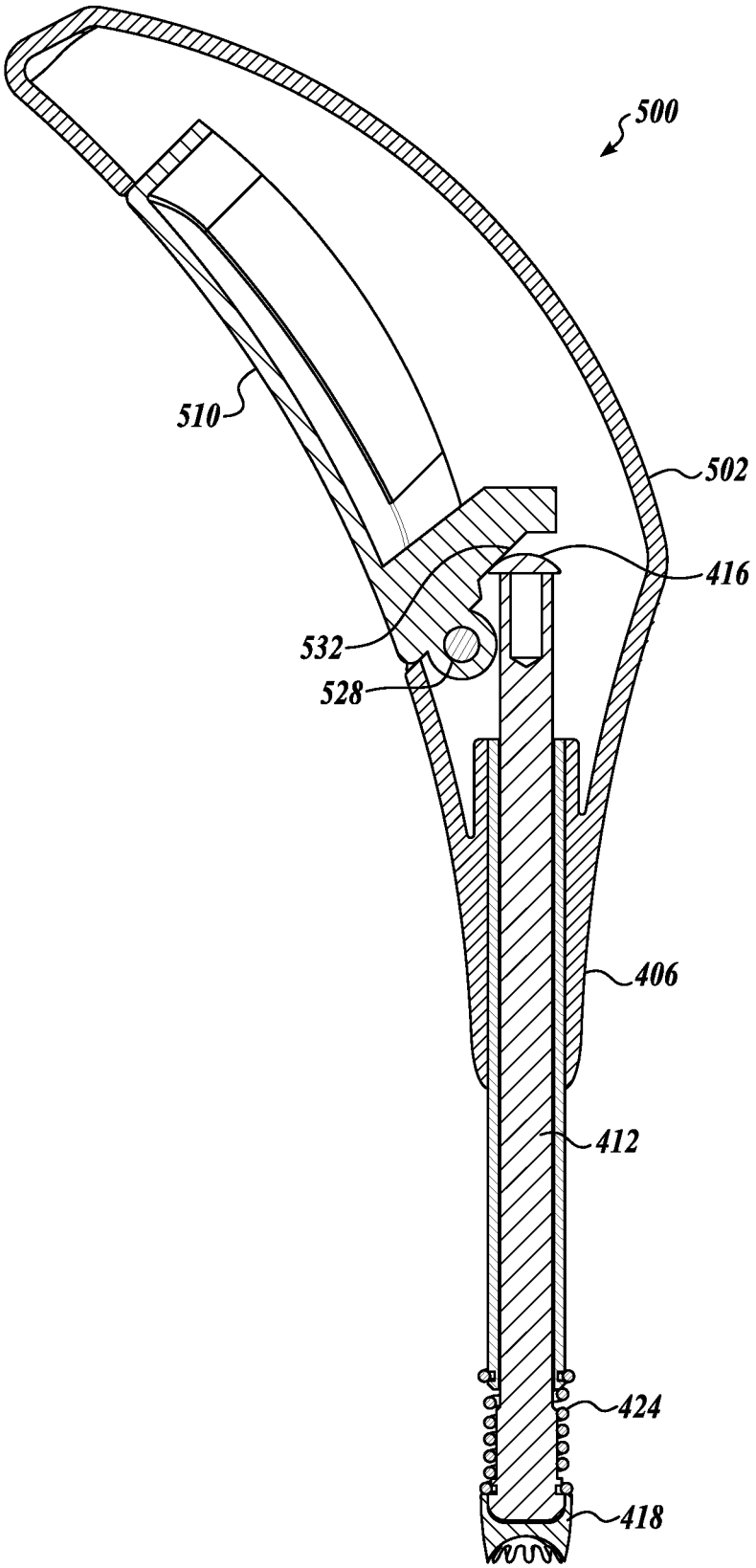
FIG. 4D is a diagrammatical illustration of a cross section of an applicator similar to the applicator of FIG. 4A.

FIG. 4D is a diagrammatical illustration of a cross section of an applicator similar to the applicator of FIG. 4A, where like numbers represent like parts that are described in relation to FIGS. 4A, 4B, and 4C. The applicator of FIG. 4D includes a body having a button 510 on opposite side as compared to the applicator 400 of FIG. 4A. The button 510 is placed on the concave surface of the body, where the button 410 is placed on the convex surface of the body. The operation of the applicator 500 is similar to the operation of the applicator 400 except with respect to the location of the button 510 (actuator 510). In FIG. 4D, the button 510 includes a pivot 528 that is placed proximally or toward the proximal end of the shaft 412 and shaft housing 406. The handle 510 includes an angled cam surface 532 that is placed eccentrically away from the pivot 528 to provide a leverage action. The cam surface 532 contacts the rounded end cap 416 of the shaft 412. Accordingly, when depressed inward, the button 510 rotates around the pivot 528, and the cam surface 532 contacts the rounded cap 416 at the proximal end of the shaft 412 at an angle, thereby applying a vertical force component as the handle 510 rotates inward that moves the shaft 412 distally to separate the coils of the spring 424 from a first closed coil configuration into a second open coil configuration to release items from the spring 424.

In an embodiment, the applicators 100, 200, 400, and 500 provide an ergonomic form of applicator with ergonomic features conducive to ease of application of cosmetic fibers and lashes configurations to the eye and around the eye and eyebrow areas, for example.

In an embodiment, the application of fibers and lashes employs an adhesive, a magnetic element, a magnetic cosmetic formulation, an adhesive mascara (adhesive with color), or the like.

In an embodiment, the applicators 100, 200, 400, and 500 provide a locking and holding first configuration as well as an open or unlocked second configuration to first engage lashes, held in interstitial spaces between clamping discs, spring coils, or retention elements, and release the false lashes when in position to apply to natural lashes.

The applicators 100, 200, 400, and 500 comprise a specialized tip at the end of the spring applicator configured to finish or fixing gestures to manage and place a partial or full false lashes, or individual fibers.

The applicators 100, 200, 400, and 500 comprise mechanical or electro-mechanical components to twist or rotate the spring either mechanically (by a hand operated assembly or motor) or electrically (powered motor) when applying.

In an embodiment, the applicators 100, 200 include a disc (round) having an asymmetric geometry (example a curved side that from the top would resemble a crescent moon) for additional functionality. In an embodiment, the symmetric form is rotatable in either direction about a rotation axis.

In an embodiment, the applicators 100, 200, 400, and 500 are configured to enable a user to extend or retract the applicator tip for range of gesture options.

In an embodiment, the applicators 100, 200, 400, and 500 are configured to enable a user to orbitally or angularly position the applicator tip for a range of applications.

In an embodiment, the applicators 100, 200, 400, and 500 include contact surfaces (spring or discs) with a coating to repel formulation, adhesives, etc., and also to slightly hold or otherwise change the surface properties inherent in the alloy of the spring, such as self-cleaning properties from hydrophobicity ("Lotus Effect"), slippery liquid-infused porous surfaces ("SLIPS"), oxidized surfaces, surfactants, films, hydrophobic/oleophobic, hydrophilic/oleophilic.

In an embodiment, the applicators 100, 200, 400, and 500 include a gripping function on one end (spring or discs) and a clamping function on the other end. Gripping false lashes aids in helping the user place the lashes, then a clamping side/function would press these lashes into a glue or an adhesive mascara, finalizing the look and placement.

In an embodiment, the applicators 100, 200, 400, and 500 are configured to easily grab/retrieve fibers, manipulate them into the best application position, and applying them to the lashes (with or without adhesive).

In an embodiment, during operation, the lash is "locked" to the discs or spring when the button is released in the first configuration, enabling easy and fluid positioning, and the lashes are released when the button is depressed in the second configuration.

In an embodiment, applicators 100, 200, 400, and 500 include surface materials or coatings that are cleanable, washable, sanitizable, etc. The disc surfaces, for example, are composed of plastics that resist the stickiness of formulations, and are also composed of antimicrobial or antibacterial materials for example.

In an embodiment, the components of the applicators 100, 200, 400, and 500 are made of plastic (e.g., PET (polyethylene terephthalate), PP (polypropylene), PE (polyethylene), or the like)), other suitable polymers, sustainable materials, additive manufactured materials, metals common to cosmetic packaging, or the like. In an embodiment, springs are typically metal, stainless steel spring stock, plastic, high density polymers, be a fulcrum or part under tension or made from sustainable/renewable materials.

In an embodiment, the applicators 100, 200, 400, and 500 are designed to be durable and reusable over many applications. The applicators improve the gesture and ability of the user to place very fine, complex fibers and forms (lashes) onto/over natural lashes and around the eye area. In an embodiment, the applicators allow the user to hold lashes passively (lashes are gripped by a mechanism) to place on the eye. In an embodiment, the applicators operate to hold fibers and lashes without pressure exerted by the user. In an embodiment, the applicators are operable to handle full and partial lashes and have several functions on the platform.

One embodiment is an applicator 100, 200, comprising, a lash retainer 108, 208 including a disc 114, 214 attached to a shaft 112, 212; an actuator 110, 210 operably coupled to the lash retainer; a disc retention element 118, 218 attached to a shaft housing 106, 206, wherein the shaft passes through the shaft housing; and a spring 124, 224 that biases the disc against at least a portion of the disc retention element in a first configuration, wherein the actuator is configured to counteract the spring and displace the disc from the disc retention element in a second configuration.

In one embodiment, the shaft 112, 212 moves linearly within the shaft housing 106, 206.

In one embodiment, the applicator 100 further comprises a housing 102 to which a proximal end of the shaft housing 106 is attached; a cam 126 to which a proximal end of the shaft 112 is attached; the actuator 110 is attached to the housing through a pivot 128, and the actuator includes a hook surface 132 on which the cam is allowed to rotate upon pivoting of the actuator.

In one embodiment, the applicator 100 includes an actuator 110 with a hook 132 on one side of the pivot and a surface projecting on the exterior of the housing, wherein the cam rests on the hook.

In one embodiment, the disc 114, 214 is placed orthogonal with respect to the shaft 112, 212, and the disc retention element 118, 218 is placed orthogonal with respect to the shaft housing 106, 206.

In one embodiment, a proximal end of the spring 124 rests on the cam 126 and the distal end of the spring is fixed.

In one embodiment, the applicator 100, 200 comprises a disc 114, 214 having a flat surface 302 on the bottom against which the upper surface 304 of the disc retention element 118, 218 presses.

In one embodiment, the applicator 100, 200 comprises a disc retention element 118, 218 that has a cupped surface facing towards a bottom surface 302 of the disc 114, 214 and a hole passing through a center of the cupped surface through which the shaft passes.

In one embodiment, the applicator 100, 200 comprises a disc 114, 214 having a planar surface 302 around the periphery, the planar surface faces towards the cupped surface, and the disc retention element 118, 218 has a flat surface 304 at the periphery of the cupped surface against which the planar surface of the disc presses.

In one embodiment, the applicator 100, 200 comprises a disc 114, 214 having an interior angled surface 308 around the periphery, and the disc retention element 118, 218 has an exterior angled surface 310 at the periphery of the cupped surface against which the interior angled surface of the disc presses.

In one embodiment, the applicator 100, 200 comprises a disc 114, 214 having an exterior angled surface 314 around the periphery, and the disc retention element 118, 218 has an interior angled surface 316 at the periphery of the cupped surface against which the exterior angled surface of the disc presses.

In one embodiment, the applicator 100, 200 comprises a compression spring that contracts in length under load.

In one embodiment, the applicator 200 comprises the spring 224 placed coaxially with the shaft 212 within a cavity 230 at a proximal end of the shaft housing 206.

In one embodiment, the applicator 200 has an actuator including a plunger 210 attached to a proximal end of the shaft 212, and one end of the spring 224 rest against a lip of the cavity 230, and the opposite end of the spring rests against an end of the plunger.

In one embodiment, an applicator 400, 500, comprises: a shaft housing 406 having a distal end and a proximal end; a shaft 412 having a distal end and a proximal end, wherein the shaft passes through the shaft housing; an expansion coil spring 424 having a distal end and a proximal end, wherein the distal end of the spring is fixed to the distal end of the shaft, and the proximal end of the spring is fixed to the distal end of the shaft housing, the coil spring includes adjacent coils pressing against each other; and an actuator 410 is configured to counteract the spring to separate the coils.

In one embodiment, the applicator 400, 500 includes a shaft 412 that moves linearly within the shaft housing 406.

In one embodiment, the applicator 400, 500 further comprises: a housing 402, 502 to which a proximal end of the shaft housing is attached; wherein the actuator includes a button 410, 510 attached to the housing via a pivot 428, 528 and the button includes a cam surface 432, 532 in contact with the proximal end of the shaft, wherein pivoting of the button inward in the housing pushes the shaft to counteract the spring 424.

In one embodiment, the applicator 400, 500 includes the proximal end of the shaft is rounded 416, and the rounded end of the shaft slides against the cam surface 432, 532 on the button as the button pivots inward.

In one embodiment, the applicator 400 includes the button 410 having a first bump 420 on the inside of the housing 402 to limit the range of pivoting inward in the housing and a second bump 450 on the button to prevent the button from rotating outward from the housing.

While illustrative embodiments have been illustrated and described, it will be appreciated that various changes can be made therein without departing from the spirit and scope of the invention.

The embodiments of the invention in which an exclusive property or privilege is claimed are defined as follows:

1. An applicator, comprising:

a lash retainer including a disc attached to a shaft;

an actuator operably coupled to the lash retainer;

a disc retention element attached to a shaft housing, wherein the shaft passes through the shaft housing, wherein the shaft moves linearly within the shaft housing;

a housing to which a proximal end of the shaft housing is attached;

a cam to which a proximal end of the shaft is attached;

the actuator is attached to the housing through a pivot, and the actuator includes a surface on which the cam is allowed to rotate upon pivoting of the actuator; and a spring that biases the disc against at least a portion of the disc retention element in a first configuration, wherein the actuator is configured to counteract the spring and displace the disc from the disc retention element in a second configuration.

2. The applicator of claim 1, wherein the actuator includes a hook on one side of the pivot and a button projecting on the exterior of the housing, wherein the cam rests on the hook.

3. The applicator of claim 1, wherein the disc is placed orthogonal with respect to the shaft, and the disc retention element is placed orthogonal with respect to the shaft housing.

4. The applicator of claim 1, wherein the disc has a flat surface on the bottom against which the upper surface of the disc retention element presses.

5. The applicator of claim 1, wherein the disc retention element that has a cupped surface facing towards a bottom surface of the disc and a hole passing through a center of the cupped surface through which the shaft passes.

6. The applicator of claim 5, wherein the disc has a planar surface around the periphery, the planar surface faces towards the cupped surface, and the disc retention element has a flat surface at the periphery of the cupped surface against which the planar surface of the disc presses.

7. The applicator of claim 5, wherein the disc has an interior angled surface around the periphery, and the disc retention element has an exterior angled surface at the periphery of the cupped surface against which the interior angled surface of the disc presses.

8. The applicator of claim 5, wherein the disc has an exterior angled surface around the periphery, and the disc retention element has an interior angled surface at the periphery of the cupped surface against which the exterior angled surface of the disc presses.

9. The applicator of claim 1, wherein the spring is a compression spring that contracts in length under load.

* * * * *